US005127461A

United States Patent [19]

Matsunaga et al.

[11] Patent Number: 5,127,461

[45] Date of Patent: Jul. 7, 1992

[54] WATER SOLUBLE CORES, PROCESS FOR PRODUCING THEM AND PROCESS FOR DIE CASTING METAL USING THEM

[75] Inventors: Kenji Matsunaga; Michiyuki Suzuki; Masahiro Tokuse, all of Ube, Japan

[73] Assignee: Ube Industries, Ltd., Yamaguchi, Japan

[21] Appl. No.: 603,843

[22] Filed: Oct. 29, 1990

[30] Foreign Application Priority Data

Oct. 31, 1989 [JP] Japan ..... 1-281846

[51] Int. Cl.[5] ..... B22C 1/18

[52] U.S. Cl. ..... 164/16; 164/522; 164/113

[58] Field of Search ..... 164/16, 522, 528, 113; 106/38.3

[56] References Cited

U.S. PATENT DOCUMENTS 3,548,914 12/1970 Hill et al. ..... 106/38.3
4,541,869 9/1985 Maak et al. ..... 164/528

FOREIGN PATENT DOCUMENTS 220523 4/1985 German Democratic Rep. ..... 164/528
49-32168 8/1974 Japan ..... 164/528
53-30922 3/1978 Japan ..... 164/528
80-01254 6/1980 PCT Int'l Appl. ..... 164/528
803476 10/1958 United Kingdom ..... 164/528

*Primary Examiner*—Richard K. Seidel
*Attorney, Agent, or Firm*—Wenderoth, Lind & Ponack

[57] ABSTRACT

Disclosed are water soluble core wherein a particulate refractory material is combined with a binding agent comprising $Na_2CO_3$, $Na_2O$ . $NSiO_2$ where n is 0.5 to 4, and $SiO_2$ as ingredients and a process for producing the water soluble core. The process comprises mixing the particulate refractory material with a water glass, casting the mixture of the particulate refractory material and the water glass, hardening the casting by $CO_2$ gas, and calcining the casting at between 100° C. and a temperature less than that of an endothermic peak of the water glass in differential thermal analysis. Also, a process for die casting a metal is disclosed using the water soluble core which process comprises pre-heating the water soluble core from a temperature of 300° C. below a melting point of the metal to a temperature of the endothermic peak.

3 Claims, 2 Drawing Sheets

WATER SOLUBLE CORES, PROCESS FOR PRODUCING THEM AND PROCESS FOR DIE CASTING METAL USING THEM

BACKGROUND OF THE INVENTION

1. Field of the Invention

This invention relates to water soluble cores, a process for producing the water soluble cores, and a process for die casting metal at high pressure using the water soluble cores.

2. Description of the Related Art

JP-A 61-118350(1986) discloses a process for producing a water soluble core, which comprises casting a particulate material containing NaCl as a main ingredient under a pressure and calcining the casting.

JP-B 48-39696(1973) and JP-B 49-15140(1974) disclose processes for producing water soluble cores, which comprise melting a particulate material containing NaCl as a main ingredient and introducing the melted material into a die.

In the process of JP-A 61-118350, however, it is difficult to produce a core having a complex shape. In the processes of JP-B 48-39696 and JP-B 49-15140, there may be a problem that it is difficult to obtain a die casting having high quality because of a change of a core size or a crack in the core caused by contraction during solidification of the melted material.

Since the cores obtained by the aforementioned processes have a high density, it takes a long time to dissolve them when washing out from a die casting. And if a part of the core remains on the die casting, it may cause corrosion of the die casting.

SUMMARY OF THE INVENTION

One object of the present invention is to provide a water soluble core wherein a particulate refractory material is combined with a binding agent comprising $Na_2CO_3$, $Na_2O$ . $nSiO_2$ where n is 0.5 to 4, and $SiO_2$ as ingredients. The water soluble core has resistance to cracking, dimensional stability, and does not cause corrosion of a die casting and deterioration of quality of the die casting.

Another object of the present invention is to provide a process for producing a water soluble core which process comprises mixing a particulate refractory material with a water glass, casting a mixture of the particulate refractory material and the water glass, hardening the thus-produced casting with $CO_2$ gas, and calcining the casting at between 100° C. and a temperature less than that of an endothermic peak in differential thermal analysis of the water glass.

A still another object of the present invention is to provide a process for die casting a metal using a water soluble core which process comprises pre-heating the water soluble core from a temperature of 300° C. below a melting point of the metal to a temperature of the aforementioned endothermic peak. This process permits producing a die casting of high quality having a thin wall and a complex shape being free from such disadvantages as a shrinkage of cavity and a misrun of a molten metal.

DETAILED DESCRIPTION OF THE INVENTION

Figure 1:
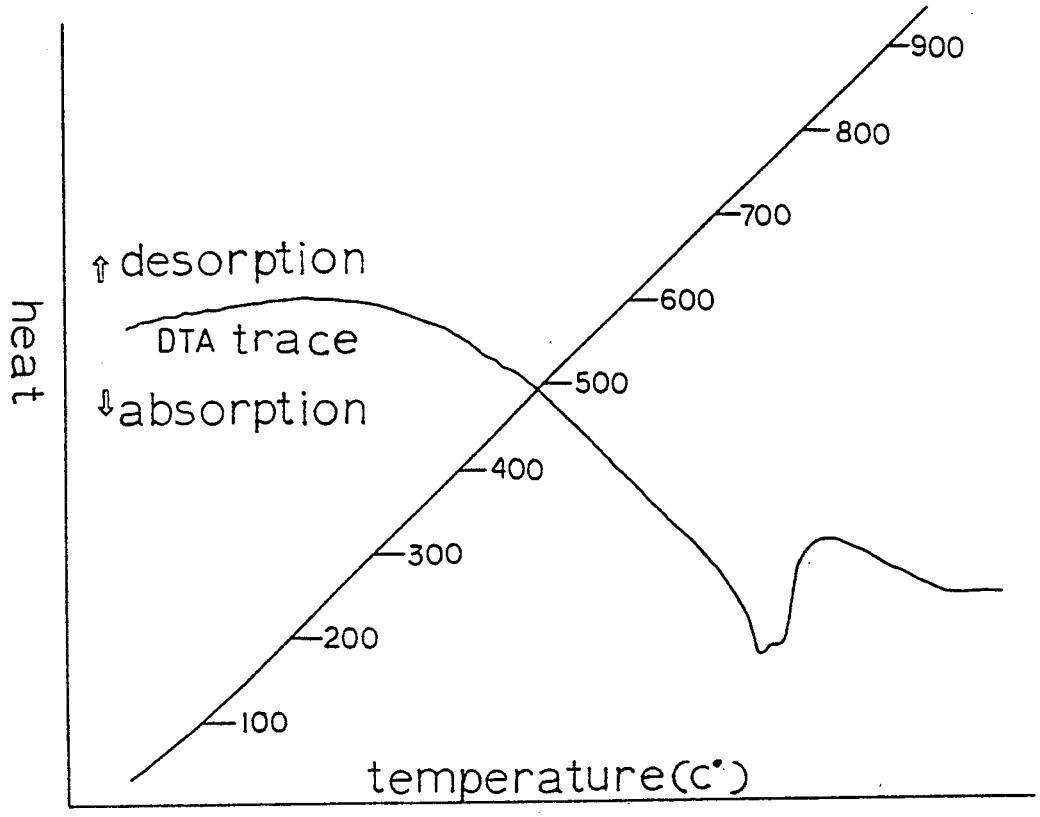
FIG. 1 shows a differential thermal analysis trace for a water glass of JIS No. 2 which was previously dehydrated by heating at 700° C.

The water soluble core in accordance with this invention is formed into the same shape as that of an undercut region of a die casting by firmly binding a particulate refractory material with $Na_2CO_3$, $Na_2O$ . $nSiO_2$ where n is 0.5 to 4, and $SiO_2$ as the binder.

The water soluble core of this invention preferably contains 85.0 to 99.0% by weight of the particulate late refractory material, 0.0015 to 2.5% by weight of $Na_2CO_3$, 0.05 to 12.0% by weight of $Na_2O$ . $nSiO_2$, and 0.1 to 12.0% by weight of $SiO_2$. The weight percent of $SiO_2$ does not indicate the amount of $SiO_2$ derived from the particulate refractory material, but actually the amount of $SiO_2$ derived only from the reaction between $CO_2$ gas and the water glass as indicated in the following chemical equation (I) where n is 0.5 to 4, x is 1 to 10, and m is 5 to 10.

$$Na_2O \cdot nSiO_2 \cdot (mn+x)H_2O + CO_2 \rightarrow Na_2CO_3 \cdot xH_2O + n(SiO_2 \cdot mH_2O) \quad (I)$$

If the amount of the particulate refractory material in the core is larger than 99.0% by weight, or the total amount of $Na_2CO_3$ and $Na_2O$ . $nSiO_2$ is too small, $Na_2CO_3$, $Na_2O$ . $nSiO_2$, and $SiO_2$ do not adhere uniformly on the surface of the particulate refractory material, and the collapsability of the core is decreased. If the amount of the particulate refractory material in the core is smaller than 85.0% by weight, or the total amount of $Na_2CO_3$ and $Na_2O$ . $nSiO_2$ is too large, undesirable decrease in a heat resistant mechanical strength occurs.

The particulate refractory material includes at least one member selected from the group essentially consisting of silica sand, zircon sand, olivine sand, chromite sand, alumina sand, chamotte sand, magnesia sand, siliconcarbide particles, and graphite particles and metal particles such as copper, iron, nickel, and chromium. An average diameter of the particulate refractory material is generally 10 to 200 μm.

The water soluble core in accordance with this invention is produced as described below. At first, a casting is produced by mixing the foregoing particulate refractory material with a water glass and casting the mixture into a desired shape. The particulate refractory material having a small content of water is desirably used. If the content of water is too large, the water glass is diluted during mixing, silica gel having a large content of water is formed, and the core having a large mechanical strength is not obtained.

Generally, a water glass of JIS No. 1, 2, or 3 can be used, but there is no limitation on the water glass, and other commercially available water glass can be also employed. The water glass is mixed with the particulate refractory material preferably in an amount of 1 to 15% by weight based on the particulate refractory material, and more preferably 3 to 6% by weight. If the amount of the water glass being mixed is less than 1% by weight, a casting from the mixture does not sufficiently retain its shape after $CO_2$ gas is passed. If the amount of the water glass is more than 15% by weight, a hardened casting is not easily obtained when $CO_2$ gas is passed.

The particulate refractory material and the water glass are mixed using an ordinary neader and the mixture is cast using a die having a desired shape. A die having a complex shape as, for example, a piston and a cooling slot of a cylinder block, can be preferably employed as well as a die having an ordinary shape. A pressure applied in casting the mixture is varied depending upon a pressure applied in die casting a metal. If the pressure applied in die casting a metal is higher, it is preferable to cast the mixture at a higher pressure. In general, the pressure applied in casting the mixture is from 0 to 2000 kg/cm$^2$. Even if a pressure of more than 2000 kg/cm$^2$ is applied, no advantage is obtained and it is not economical.

The hardened core can be prepared by introducing $CO_2$ gas to the foregoing casting. There is no limitation in particular on a method and condition in which the $CO_2$ gas is introduced. A preferable condition can be varied depending upon the shape and the size of the casting. The flow of $CO_2$ gas may be continued until the casting is hardened. By passing $CO_2$ gas, a reaction between a water glass and the $CO_2$ gas may proceed according to the chemical equation (I) as indicated before and the casting is hardened.

In order to prepare the water soluble core, the casting hardened by $CO_2$ gas is lastly calcined at between 100° C. and a temperature of an endothermic peak of the water glass. The endothermic peak of the water glass can be determined by differential thermal analysis. FIG. 1 shows a result of differential thermal analysis for a water glass of JIS No. 2. A sample for differential thermal analysis was previously dehydrated by heating at 700° C. and accordingly, there appears no endothermic peak ascribed to dehydration of the waterglass in FIG. 1. The endothermic peak of the water glass of the present invention is not meant a peak ascribed to dehydration of the water glass which appears between about 100° and 200° C., but the endothermic peak which appears at a higher temperature. From this figure, the endothermic peak of the water glass of JIS No. 2 is observed at between 740° and 750° C. If the foregoing casting is heated at below 100° C., the calcination is not satisfactory carried out. If the casting is heated at above a temperature of the endothermic peak of the water glass, the casting calcined is unsuitably converted to a water insoluble core through reactions between the products indicated in the foregoing chemical equation (I) or between the unreacted water glass and the product.

A metal is die cast using the foregoing water soluble core. Metals for die casting of the present invention include, for example, aluminum, aluminum-alloy, magnesium, and magnesium-alloy. In die casting, the core must be pre-heated from a temperature of 300° C. below a melting point of the metal to a temperature of the endothermic peak of the water glass. If the temperature of pre-heating is under the lower limit, and a space between a die casting mold and the core is narrow, a product is obtained having defects such as shrinkage cavity and misruns, that is, there is insufficient distribution of the molten metal into the space. If the temperature of pre-heating is above the upper limit, the core becomes water insoluble as described before and the purpose of the present invention can not be accomplished.

From the following reason, the pre-heating temperature of the core is preferably lower than the calcination temperature of the casting from the mixture of the particulate refractory material and the water glass. As long as the pre-heating temperature is below the calcination temperature, a change of a core size does not occur in pre-heating which change might have occured in calcination. By determing the core size after calcination, a die casting having predetermined size can be produced. If the change of the core size does not occur, calcination and pre-heating of the core may be carried out at the same time. In this case, the pre-heating process can be advantageously omitted. In an example of die casting aluminum-alloy, a preferable calcination temperature is 450° to 700° C., and the preferable pre-heating temperature is 400° to 650° C.

In general, the pre-heating temperature of the core is adjusted to below a temperature above which the surface penetration of a molten metal to the core occurs. If surface penetration still occurs, then the surface of the core may be coated with a refractory material to prevent penetration. A method of coating the core with the refractory material of the present invention may include using a solution of inorganic particulate refractory materials, an inorganic binding agent, and an organo-metallic compound as disclosed in Japanese Patent Application 33138/1989. Examples of the inorganic particulate refractory material are oxides such as silicon sand, zircon sand, and fused silica, metal particles such as copper, iron, and nickel, and carbides such as silicon carbide and graphite. Examples of the inorganic binding agent are a water glass, coloidal silica, coloidal alumina, and dehydrated metal alkoxide mixed with a gelling agent. Examples of the organo-metallic compound are compounds containing titanium, aluminum, or silicon as a metal component. A method of coating the core with the refractory material includes, for example, brushing, dipping, and spraying.

PREFERRED EMBODIMENTS OF THE INVENTION

The present invention is now described with reference to Examples.

EXAMPLE 1

Figure 2:
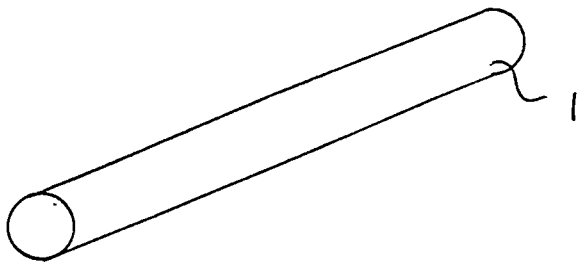
FIG. 2 is a diagram of a water soluble core.

Zircon sand having an average particle diameter of 100 microns was mixed and kneaded with 5% by weight of a water glass of JIS NO. 2 based on the zircon sand. The mixture was introduced into a die made of iron and a pressure of 1000 kg/cm$^2$ was applied to produce a casting having a 20 mm diameter and a 150 mm length. The casting was hardened by passing $CO_2$ gas and then calcined at 650° C. under an atmospheric pressure to produce a core 1 shown in FIG. 2.

Figure 3:
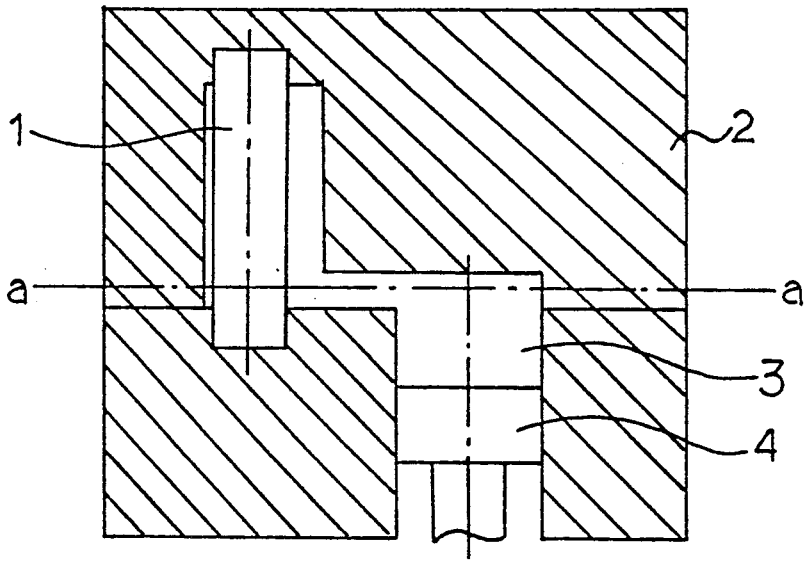
FIG. 3 is a longitudinal section of a die casting mold used in Example 1 to produce a cylindrical die casting having an undercut region.
Figure 4:
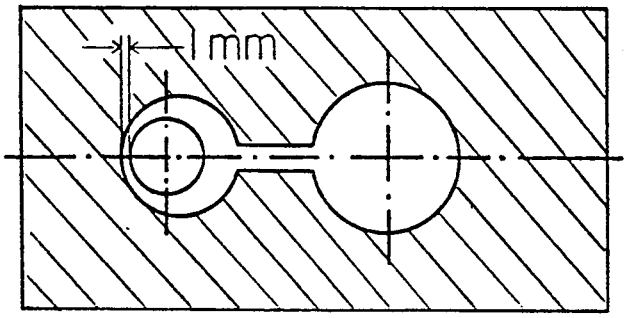
FIG. 4 is a cross section taken along line a—a of FIG. 3.

After pre-heating at 550° C. for 30 min. under an atmospheric pressure, the core 1 was placed in a die casting mold 2 shown in FIG. 3. The thinest space between the core 1 and a surface of the die casting mold 2 was 1 mm. Next a molten aluminum-alloy (JIS AC8A) of 700° C. was injected into the die casting mold 2 using a plunger 4 under a pressure of 1000 kg/cm$^2$. After solidification of the aluminum-alloy, the die casting was removed from the die casting mold 2 and the core 1 was separated from the die casting by simply washing out the core 1 with a jet water flow.

No flash was observed on the surface of the die casting, no shrinkage cavity was observed in a cross section of the thinnest part of the die casting and no corrosion was observed in an under cut region of the die casting even a week later.

COMPARATIVE EXAMPLE 1

NaCl having an average particle diameter of 100 microns was introduced into the die made of iron and a pressure of 2000 kg/cm$^2$ was applied to produce a casting having a 20 mm diameter and a 150 mm length. The NaCl casting was calcined 700° C. for 2 hours under an atmospheric pressure to produce a core.

Die casting of aluminum-alloy in Example 1 was repeated wherein the core was made of NaCl. However the core could not be easily separated from a diecasting and more than 3 hours were needed for separation compared with Example 1.

Cavity shrinkage and misruns were observed in a cross section of the thinnest part of the die casting which part is far from the plunger and corrosion was observed in an under cut region of the die casting the week later.

COMPARATIVE EXAMPLE 2

Productions of a core made of NaCl and a die casting in Example 1 were repeated wherein the NaCl casting was calcined at 800° C. The separation of the NaCl core from a die casting was impossible by washing out.

We claim:

1. A process for producing a water soluble core wherein a particulate refractory material is combined with a binding agent comprising $Na_2CO_3$, $Na_2O \cdot nSiO_2$ where n is 0.5 to 4, and $SiO_2$ as ingredients, which process comprises mixing a particulate refractory material with a water glass, molding a mixture of the particulate refractory material and the water glass, hardening the thus-molded refractory by $CO_2$ gas, and calcining the molded refractory at between 450° C. and a temperature less than that of the endothermic peak of the water glass in differential thermal analysis.

2. A process for producing a water soluble core as defined in claim 1 in which the particulate refractory material is mixed with 1 to 15% by weight of the water glass based on the refractory material.

3. In a process for die casting which comprises placing a water soluble core in a die casting mold, injecting a molten metal into the die casting mold and separating the water soluble core from the die casting by washing with water, the improvement wherein the water soluble core is the core produced for the process of claim 1 in which the core has been preheated before casting at a temperature of from 300° C. below the melting point of the metal to a temperature of the endothermic peak of the water glass.

* * * * *